US006718711B1

(12) United States Patent
Gilman

(10) Patent No.: US 6,718,711 B1
(45) Date of Patent: Apr. 13, 2004

(54) PREFABRICATED HOUSING

(75) Inventor: Robert L. Gilman, Wasilla, AK (US)

(73) Assignee: Alutiiq Manufacturing Contractors, LLC, Anchorage, AK (US)

( * ) Notice: Subject to any disclaimer, the term of this patent is extended or adjusted under 35 U.S.C. 154(b) by 0 days.

(21) Appl. No.: 09/490,366

(22) Filed: Jan. 24, 2000

Related U.S. Application Data

(60) Provisional application No. 60/117,227, filed on Jan. 26, 1999.

(51) Int. Cl.[7] ..... E02D 27/32

(52) U.S. Cl. ..... 52/299; 52/125.4; 52/169.9

(58) Field of Search ..... 52/169.9, 299, 52/79.1, 79.2, 79.3, 79.14, 274, 745.2, 745.02, 745.03, 125.2, 125.4

(56) References Cited

U.S. PATENT DOCUMENTS

| | | | | | |
|---|---|---|---|---|---|
| 960,207 | A | | 5/1910 | Slater | |
| 2,129,211 | A | * | 9/1938 | Hickl | 52/299 |
| 3,279,132 | A | | 10/1966 | Slayter | |
| 3,430,398 | A | * | 3/1969 | Green | 52/79.2 |
| 3,789,559 | A | | 2/1974 | Kirkes | |
| 3,792,558 | A | * | 2/1974 | Berce et al. | 52/79.2 |
| 3,832,811 | A | * | 9/1974 | Briel, Jr. | 52/79.13 |
| 3,908,321 | A | * | 9/1975 | Cox et al. | 52/79.1 |
| 4,012,871 | A | * | 3/1977 | Netto et al. | 52/79.01 |
| 4,065,905 | A | * | 1/1978 | van der Lely | 52/79.1 |
| 4,275,538 | A | | 6/1981 | Bounds | |
| 4,685,258 | A | | 8/1987 | Av-Zuk | |
| 4,854,094 | A | * | 8/1989 | Clark | 52/79.1 |
| 4,882,883 | A | * | 11/1989 | Horn | 52/79.1 |
| 5,359,821 | A | | 11/1994 | Merriman | |
| 5,363,610 | A | | 11/1994 | Thomas et al. | |
| 5,561,950 | A | | 10/1996 | Collins et al. | |
| 5,590,494 | A | | 1/1997 | Miller | |
| 5,784,844 | A | | 7/1998 | Mackarvich | |

* cited by examiner

*Primary Examiner*—Michael Safavi
(74) *Attorney, Agent, or Firm*—Christensen O'Connor Johnson Lindness PLLC

(57) ABSTRACT

A prefabricated housing unit designed to be placed on top of ground bases 42. The housing unit 10 has a housing shell 13 having longitudinal and transverse lower edges and a foundation structure 12 incorporated into and underlying the housing shell 13. The foundation structure 12 of the present invention has longitudinal beams 14 that span the entire length of the housing shell edges, and transverse beams 16 that join with the longitudinal beams at the corners. The corner junction is a load bearing point, while the remainder of the longitudinal beams remain substantially unsupported above the ground between the load bearing points.

16 Claims, 6 Drawing Sheets

PREFABRICATED HOUSING

The present application claims the benefit of the filing date of U.S. Provisional Application Serial No. 60/117,227, filed Jan. 26, 1999.

FIELD OF THE INVENTION

This invention pertains to pre-manufactured housing units, more particularly to a pre-manufactured housing unit designed with a foundation structure, integral frame and supports to withstand appreciable sag or flex in the foundation.

BACKGROUND OF THE INVENTION

Harsh environments, such as the frozen tundras of Alaska, demand that suitable housing units be extremely weatherable. The conditions created by such harsh climates creates problems not currently being addressed in the pre-fabricated housing market. Existing housing units are designed to be supported at many different load bearing points along their foundation, thereby creating a transportation problem when moving the unit to its ultimate location. Such homes can not be stacked on top of one another since all load bearing points could not be equally supported, especially the ones in the interior foundation. Thus, relocation from manufacturer to end user requires sophisticated and expensive moving equipment.

Typical housing units are built with a beam in the middle of the foundation structure running lengthwise of the structure. Transverse beams are then located between the middle longitudinal beam, and extending outward to the sides of the unit. The outer longitudinal beams as well as the middle beam require a number of support posts and pads. A typical problem encountered with conventional post and pad configurations is differential settling. Differential settling of the support posts and pads is caused by setting of the gravel base on unstable ground or by passive solar melting of the frozen subsurface around the perimeter of the unit. Sometimes, the bases are buried in the ground which causes a disturbance to the underlying natural vegetative mat resulting in an unstable and expanding sinkhole as permafrost thaws to new depths. In addition, frost heaving causes similar disturbances to the gravel base and affects the support posts and pads in much the same manner as settling. Collectively, these effects cause some support posts and pads to become disproportionately overloaded or to become suspended. Because the foundation structure of the conventional housing unit is designed for proportionate loads to each of the support posts and pads, the foundation structure undergoes flexing over the more stable posts and pads, as for example, when a corner sinks. The housing unit is then destroyed as a result of such settling. When differential settling occurs in the immediate area of the base, the pad becomes uneven or nonbearing.

The present invention overcomes the major disadvantages of the prior art. The housing unit according to the present invention uses a rigid foundation structure in combination with an integral frame that allows the housing unit to be picked up at the ends and be stacked on top of one another because all the foundation load bearing points will be supported by the frame of the underlying housing unit. In addition, the housing unit of the present invention incorporates an alternative design which uses materials of construction that are capable of spanning the entire length of the housing unit allowing the foundation structure to be supported by a post and pad combination at each corner, thus, eliminating the middle longitudinal beam and associated cross beams and related support posts. Settling in one corner is countered by the rigid foundation and frame which transfer the load to the non-affected support posts and pads without any appreciable sag or flex of the foundation. The affected pad could then be easily raised to relieve the overloading or lowered to increase its load. In addition, the pad of the present invention is braced to the post in such a manner that the pad remains horizontal regardless if there is localized shifting of the immediate base. This is beneficial when only a portion of the base shifts, such that if at least one side of the pad remains in contact with the base, the pad will not canter, but will remain level and able to support its proportionate share of the load. Conventional foundation pads are supported on a leveling course of gravel or in a few cases placed directly on the ground. Gravel is very expensive in many villages as it must be barged in and then often transported over-land without the benefit of roads. Besides the high cost of gravel, another negative is that the gravel becomes a "heat sink" for solar energy. The warm gravel then melts the frozen ground or permafrost below and then causes settling. Most of the time, the gravel pads are actually insulated from the subsurface with expensive rigid insulation. The housing unit of the present invention may rest on the ground, gravel pads or tundra, or alternately and suitably may use sawdust and/or wood chips as a leveling course. The sawdust/chips are inexpensive, lightweight and inexpensive to transport and handle, and provide excellent insulation to help prevent sub-surface thawing. Wood chips/sawdust are also environmentally friendly.

SUMMARY OF THE INVENTION

The present invention is a prefabricated housing unit designed to be placed on top of ground bases. The housing unit has a housing shell having longitudinal and transverse lower edges and a foundation structure incorporated into and underlying the housing shell. The foundation structure of the present invention has longitudinal beams that span the entire length of the housing shell edges, and transverse beams that join with the longitudinal beams at the corners. The corner junction is a load bearing point, while the remainder of the longitudinal beams remain substantially unsupported above the ground between the load bearing points.

The preferred embodiment uses a rigid material of construction for the foundation structure and an integral frame that transfers the bending moments from one load bearing point to an adjacent point in the event of a base subsiding into the ground. The integral frame has corner columns that are braced to adjacent columns or to the foundation structure by diagonal braces. The top ends of the columns are interconnected with longitudinal and transverse ties to add to the structure's rigidity. The corner columns penetrate through the foundation structure. The corner column is preferably hollow to allow a support post to vertically slide within the corner column, allowing adjustment of the height of the support post. A clamp is slidably adjustable on the support post. The clamp bears the load of the lower terminus of the corner column. The lower end of the support post further has a support pad connected by several diagonal braces. The support pad firmly rests on a base. The base is preferably made from fragmented wood materials. The base may have a protective cap of gravel or silt.

The present invention is further directed to a method of designing a prefabricated housing unit such that the combination of foundation structure and integral frame prevent any appreciable sag or bending of the foundation structure. The entire housing unit is supported by load bearing points at or near the corners. Such a design also has the feature of transferring the bending moments from one loading point to adjacent loading points upon subsidence of the ground on which a base rests without appreciable sag or flex of the foundation. The foundation structure and integral frame design also allow the housing units to be hoisted from the ends of the structures and placed on top of each other because all the load bearing points are supported by the underlying housing unit frame. The pad to post connection is designed to allow each pad to bear on any one side upon subsidence of the immediate ground or base on which the pad rests. This suitably includes diagonal bracing of the pad to post, cast into the concrete when concrete pads are used and bolted bracing when we use timber pads. The preferred base material of the present invention also counters the subsidence of the ground due to passive solar radiation.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
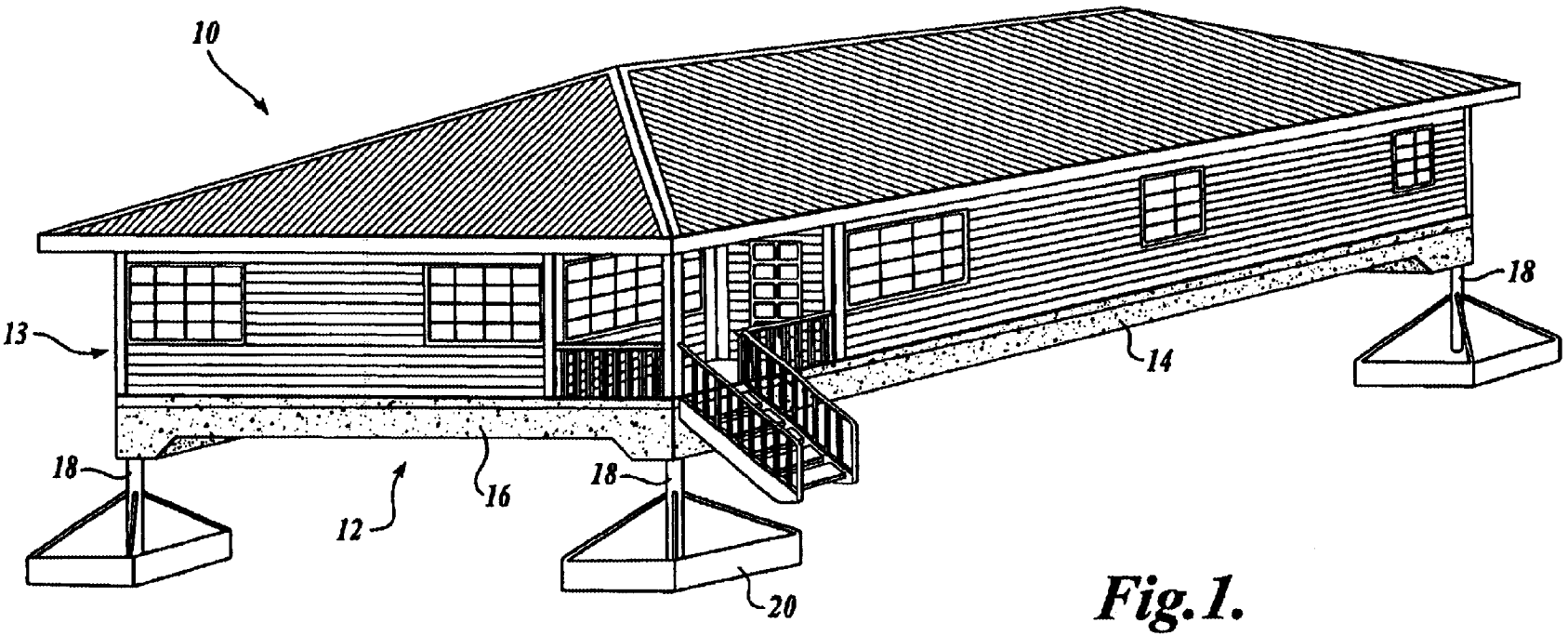
FIG. 1 shows a schematic view of the foundation structure, supports, and housing shell.
Figure 2:
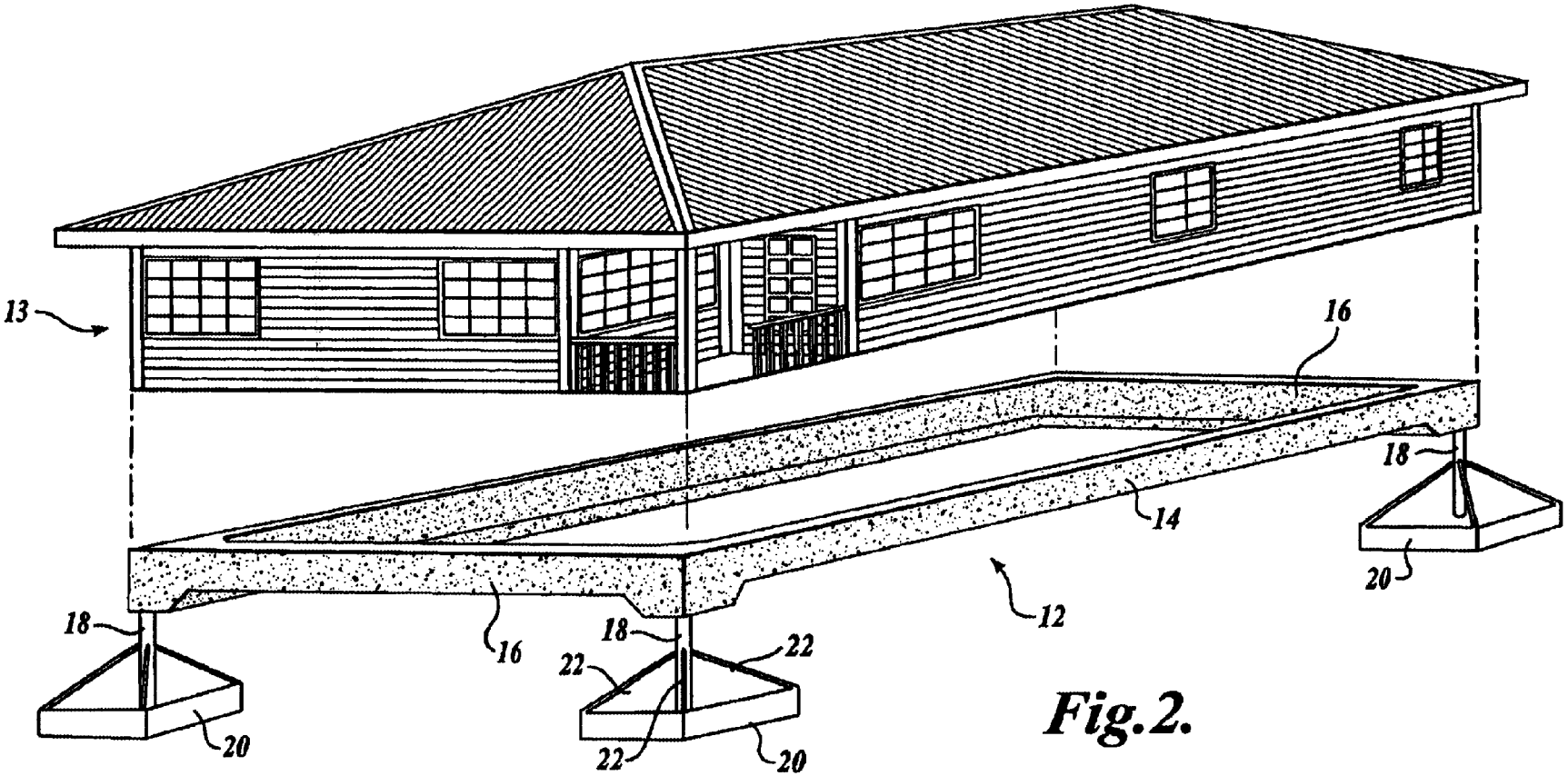
FIG. 2 shows an exploded view of the housing shell being configured to rest on top of the foundation structure and supports.

The present invention provides premanufactured housing units 10 including a foundation structure 12 that is integrated with a housing shell 13, as shown in FIG. 1. Referring to FIGS. 1 and 2, the structural support 12 includes longitudinal beams 14 supporting the longitudinal edges of the housing shell 13, i.e., the longitudinal edges of the flooring and floor joists, and the load bearing outer walls. The longitudinal beams 4 are spanned at opposite ends by transverse beams 16, which likewise support the outer bearing walls of the housing shell 13. The beams 14, 16 of the structural support 12 are constructed from a rigid structural material, such as concrete reinforced with rebar or other reinforcement material, or steel, or engineered wood beam. The construction materials and dimensions are selected for a predetermined flexural strength such that the entire housing unit 10 can be supported at only at the four corners of the support structure 12, or as discussed below even by only three corners.

Thus the longitudinal beams 14 have a predetermined strength and resistance to flexure such that when supported by posts located under the ends of the opposing beams, or near the ends of the opposing beams, the longitudinal beams 14 do not flex or sag appreciably. Moreover, the support structure 12, which is suitably formed as a unitary concrete reinforced structure, is sufficiently strong such that the entire support structure 12, when fully loaded, may be supported by any three of the four corners, again without appreciable flexure or sagging of the housing structure 13 or internal flooring. While intermediate supports may be placed between the corners along the beams 14, 16, they are not required and are completely optional.

The housing units 10 are ideally suited for use in arctic or Antarctic tundra conditions, wherein thawing of permafrost and frost heave may result in the supporting ground becoming unlevel after installation. The corners of the support structure 12 are ideally supported by four posts 18, as shown in FIGS. 1 and 2. Each post 18 is located underneath a corner of a support structure 12, and is supported by a foundation pad 20, constructed of concrete, steel or timber. The foundation pads 20 are braced with diagonal braces 22 to the corner posts 18. This load distribution enables each corner post 18 to support its proportional share of the load even if the supporting ground, which may be gravel or wood chips in accordance with the present, should become uneven. Thus support along any one edge of the foundation pad 20 is sufficient to support the post 18 and its proportionate load.

Figure 3:
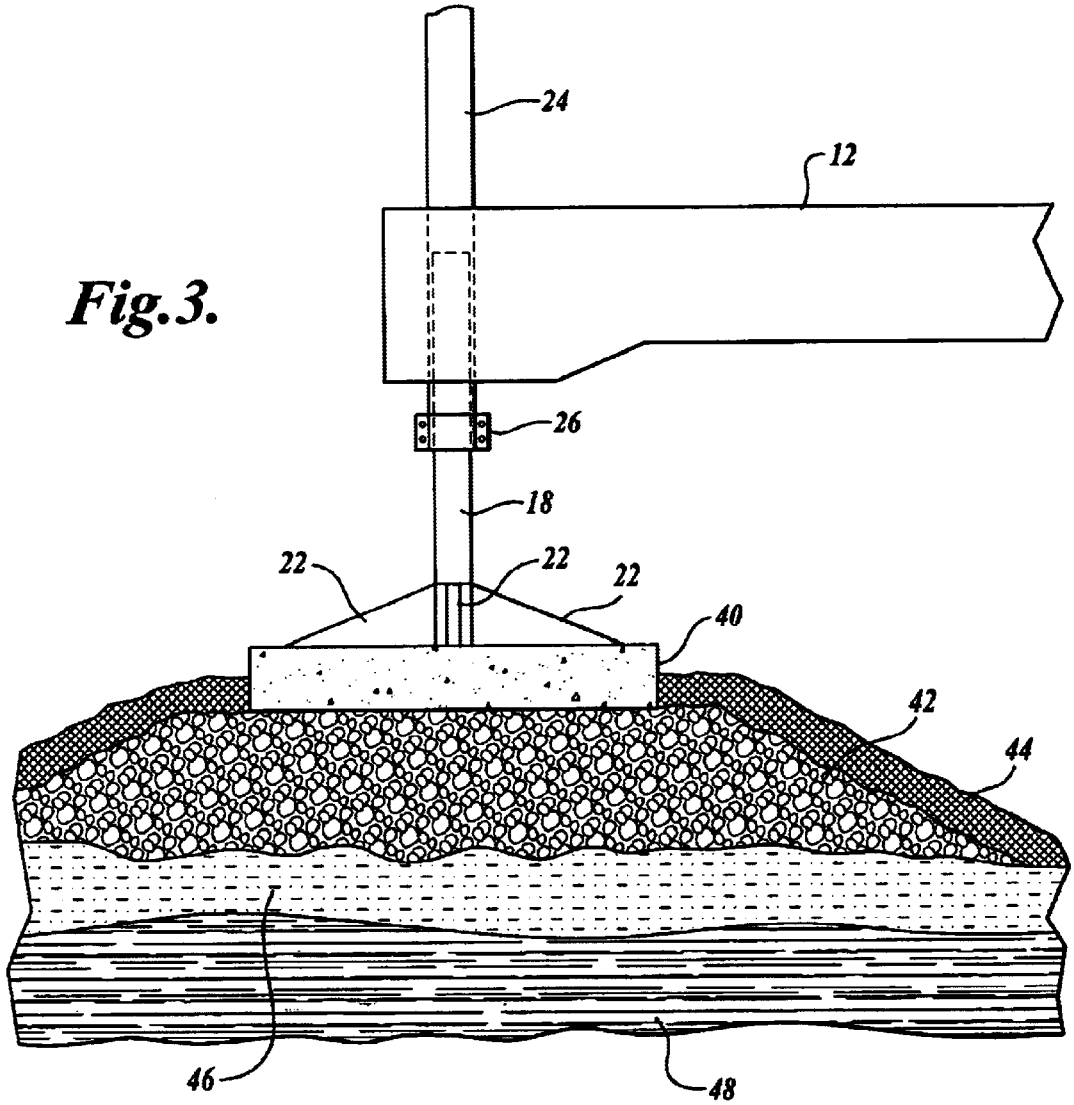
FIG. 3 shows a plan view of the supports including foundation post, foundation pad, clamp and the underlying base.

Referring to FIG. 3, the foundation posts 18 are suitably adjustably mounted to the support structure 12 to permit vertical adjustment for installation on uneven ground, or to accommodate changes in the ground terrain. The housing shell 13 includes four vertical corner columns 24. Each corner column 24 extends vertically through and is secured within a corner of the support structure 12. Each corner column 24 is suitably a hollow steel tube.

The corresponding foundation post 18 is slidably received within the lower end of the corner column 24. A clamp 26 is secured about the foundation post 18 immediately below the lower terminus of corner column 24. The corner column 24 bears on the thusly secured clamp 26, which transmits the load to the foundation post 18. The clamp 26 can be loosened and slid upwardly or downwardly to change the distance that the foundation post 18 projects downwardly below the corner column 24. Thus each foundation post 18 may be independently adjusted upon placement of the housing unit 10. Thereafter upon change in the terrain, each foundation post may be adjusted by jacking up the corner of the support structure 12, undoing the clamp 26, sliding the foundation post 18 upwardly or downwardly as may be required, and resecuring the clamp 26.

The corresponding foundation pad 40 is secured to the lower portion of foundation post 18 by a plurality of reinforcement braces 22. Foundation pad 40 is made of a suitable material such as concrete, steel or timer pad. Foundation pad 40 is aptly suited to rest on the ground, tundra, gravel or wood chip base 42. Were a portion of the base 42 or ground underlying the foundation pad 40 to subside due to differential settling, reinforcement braces 22 connecting the foundation pad 40 to the foundation post 18 keep the pad horizontal so that the pad portion remaining in contact continues to bear the proportionate share of the housing load. To counter the effects of passive solar melting, a suitable base made of fragmented wood materials may be used. The wood fragment base is formed on top of the underlying ground, tundra, permafrost or gravel. The fragmented wood material may be protected with an optional cap of gravel or silt 44.

Figure 4:
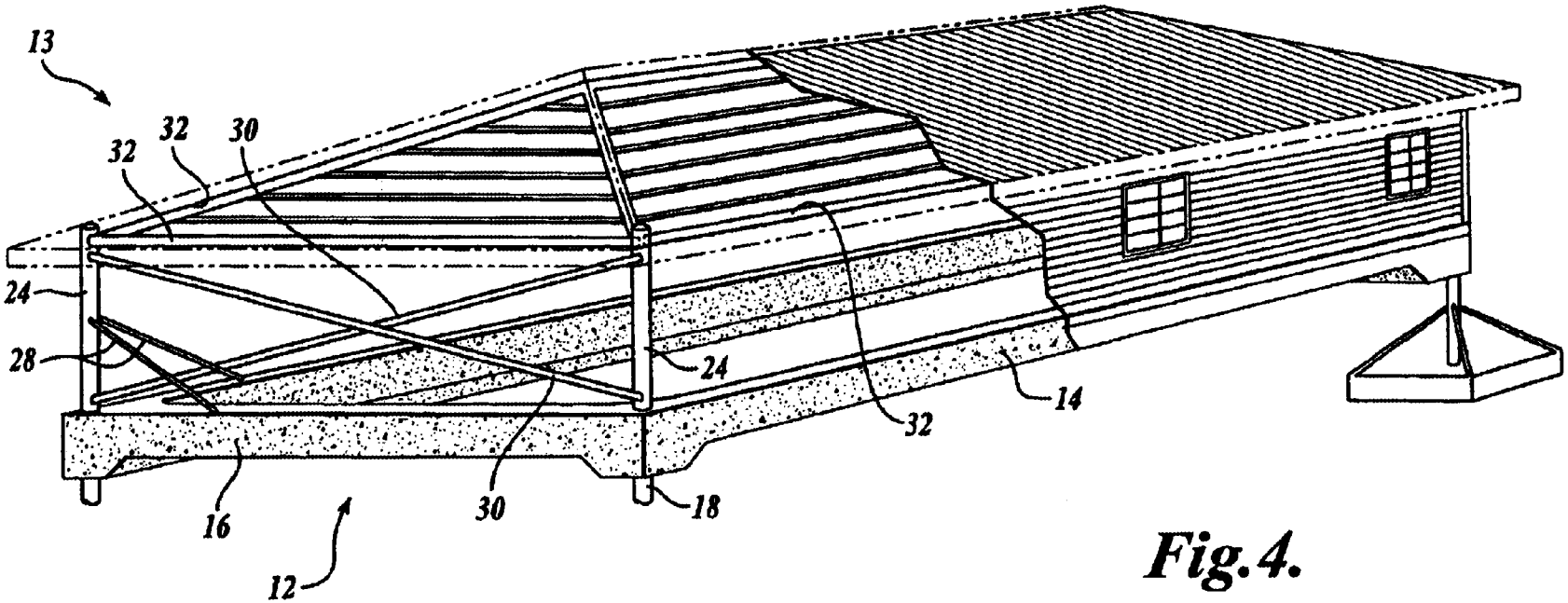
FIG. 4 shows a schematic view of the integral frame of the housing shell.

The rigidity of the support structure 12, and the ability of the longitudinal beams 14 to be supported fully only by posts placed at or near the ends, as well as the ability of the entire support structure to be rigidly supported by posts placed only at three corners, is further enabled by a braced frame construction of the housing shell 13. Referring to FIG. 4, the housing shell 13 is internally supported by the four corner columns 24. Each of these corner columns is braced by diagonal braces extending from the corner columns 24 to the support structure 12 and to adjacent corner columns 24. Specifically referring to FIG. 4, each corner column 24 is braced by diagonal braces 28 extending from corner column 24 at a point approximately midway along its height to the adjacent longitudinal beams 14 and transverse beams 16. Additionally, diagonal braces 30 extend from an upper end of each corner column 24 to a lower end of an adjacent corner column 24. The orientation and number of the braces 28 and 30 may be varied from that shown as required to achieve a predetermined level of rigidity. The braces 28 and 30 are secured, such as by welding or riveting to the corner columns 24 and by bolting to embedded inserts in the reinforced concrete support structure 12 or by other means well known to those of ordinary skill in the art. Additionally, the upper ends of the corner columns 24 are interconnected by longitudinal and transverse ties 32 extending around the perimeter of the housing shell 13 at the roof line.

Figure 5:
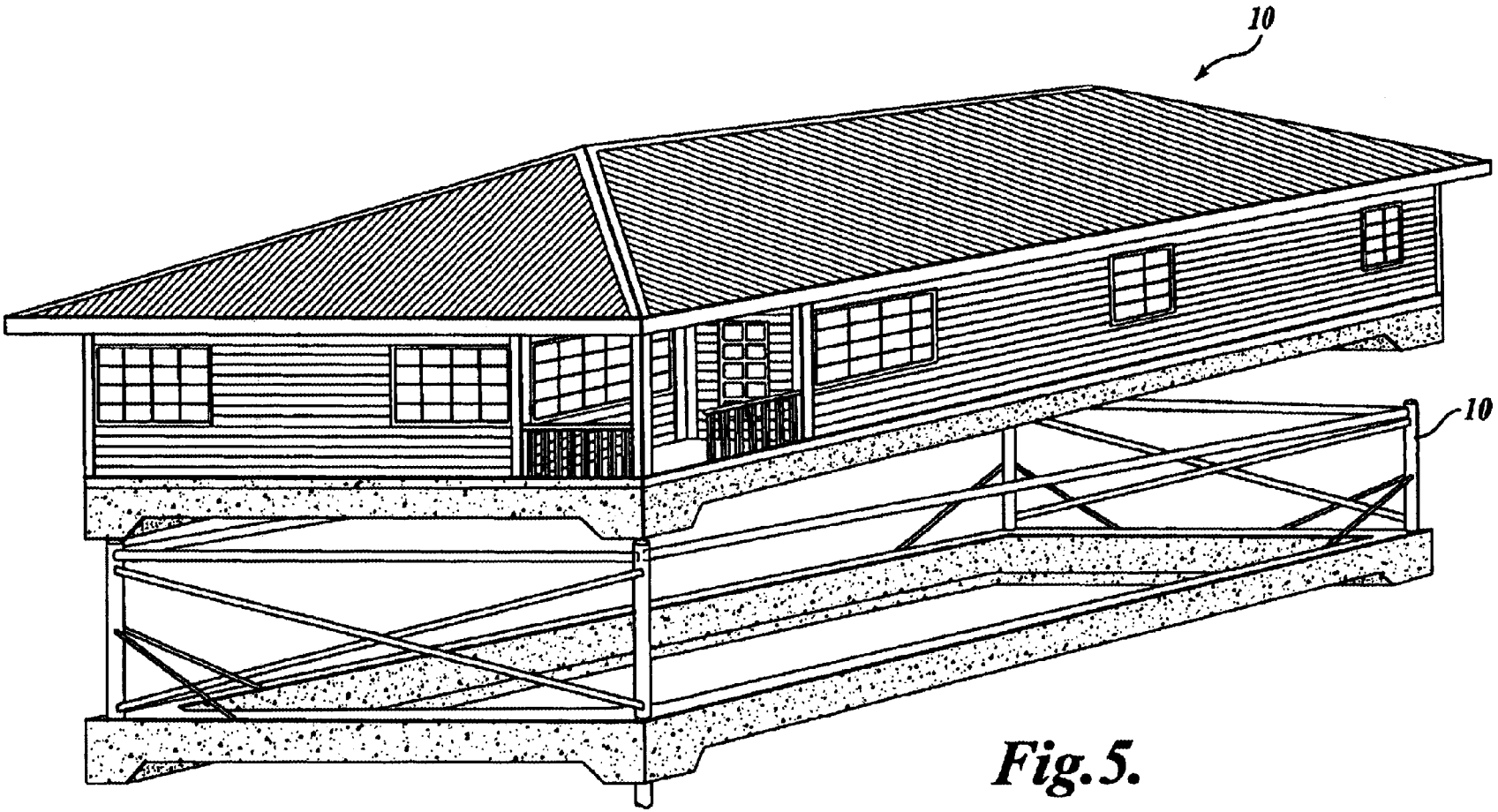
FIG. 5 shows a schematic view of the integral frame of the housing unit supporting another housing unit for transporting.
Figure 6:
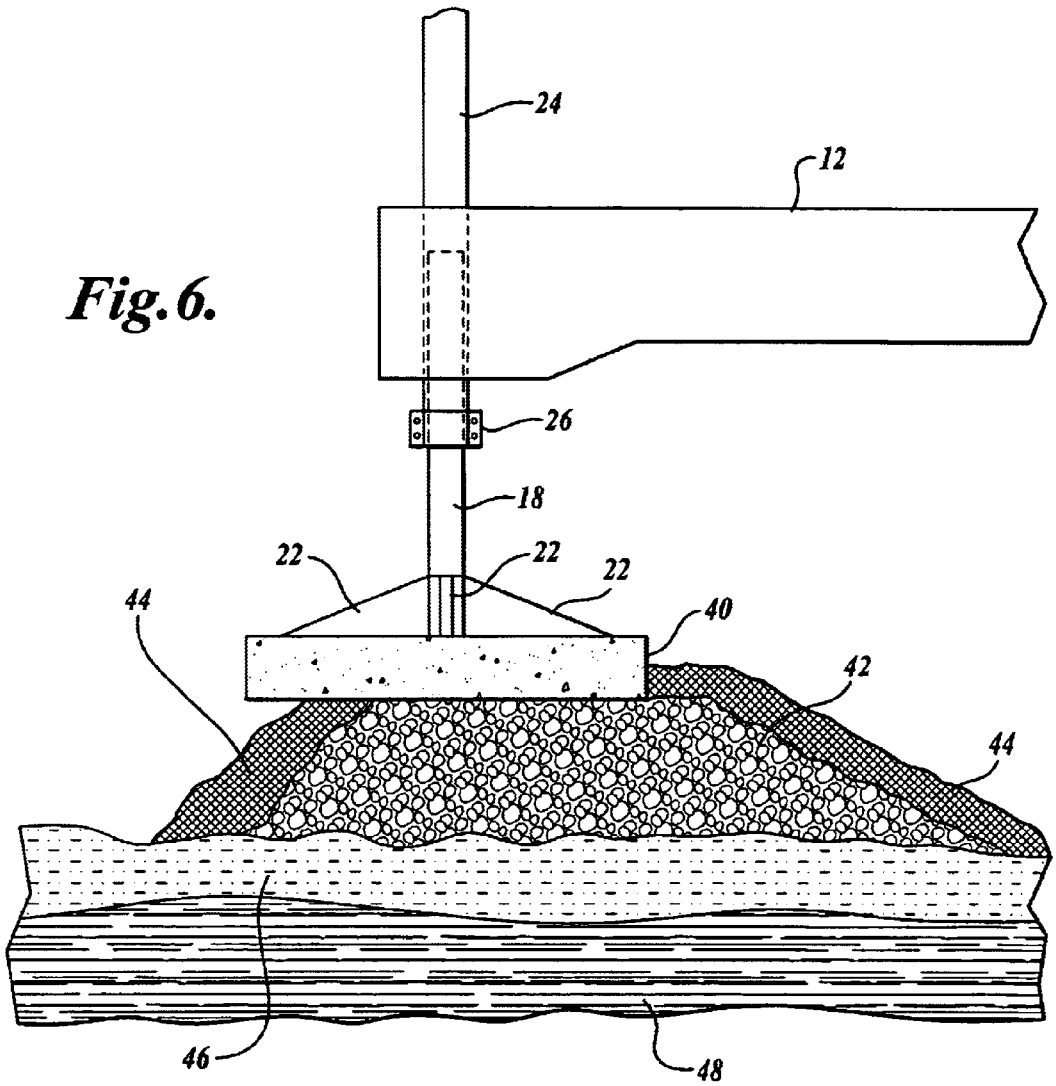
FIG. 6 shows a housing unit bearing on an uneven base.

A further advantage of the present invention is illustrated in FIG. 5, which shows that multiple housing units 10 can be stacked for shipment, such as by barge. The lower ends of the corner columns 24 of a first unit bear on the upper ends of the corner columns 24 of the lower unit for stacking. The housing unit foundation structure is designed to be lifted by each end beam only, and transported overland with no additional support.

The housing unit can contain davits 50 located on opposing ends of the flexurally rigid structure 14 for hoisting.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A prefabricated housing unit, defining a load, comprising:

a housing shell having longitudinal and transverse lower edges, said edges defining longitudinal and transverse lower resting portions;

a flexurally rigid foundation structure incorporated into and underlying said housing shell including elongate longitudinal beams spanning said longitudinal edges, wherein said lower resting portions of said longitudinal edges bear on said longitudinal beams, and elongate transverse beams spanning said transverse edges, wherein said lower resting portions of said transverse edges bear on said transverse beams, wherein said longitudinal beams and said transverse beams cooperatively define a substantially rectangular perimeter of said housing shell, wherein ends of said longitudinal beams are joined to corresponding ends of said transverse beams in a horizontal plane to form a plurality of juncture portions, wherein each of said juncture portions defines a bearing point, each of said bearing points bearing an apportioned share of said housing unit load, said longitudinal beams being substantially unsupported above the ground along their lengths between the juncture portions.

2. The housing unit of claim 1 wherein said flexurally rigid foundation structure includes davits, for hoisting said housing unit, disposed on opposing ends of said structure.

3. The housing unit of claim 1, wherein said flexurally rigid foundation structure is constructed from a rigid structural material selected from the group consisting of reinforced concrete, steel, and wood.

4. The housing unit of claim 3, wherein the foundation structure is a unitary concrete reinforced structure.

5. The housing unit of claim 4, further comprising a plurality of ground bases underneath each bearing point, wherein said flexurally rigid foundation structure has a predetermined rigidity such that upon subsidence of one of said bases, the apportioned load of said base is apportioned to the remaining bases without significant sagging of the foundation structure.

6. The housing unit of claim 1, further comprising:

a corner column having a lower end, a foundation post slidably received within said column lower end, and a vertically adjustable clamp secured about the foundation post below said lower end of said column such that said column bears on said clamp to provide an independently vertically adjustable bearing point.

7. The housing unit of claim 1, wherein each of said bearing points is apportioned said housing unit load wherein at least one bearing point lies atop an uneven base, said bearing point remaining substantially horizontal and bearing a proportional share of said housing unit load.

8. The housing unit of claims 1, wherein said housing shell further comprises a plurality of corner columns extending vertically through said foundation structure upwardly into said housing shell.

9. The housing unit of claim 8, wherein said housing shell further comprises:

a plurality of diagonal braces interconnecting said corner columns to said flexurally rigid foundation structure; and a plurality of diagonal braces interconnecting adjacent corner columns.

10. The housing unit of claim 9, wherein said housing shell further comprises a plurality of longitudinal and transverse ties connecting top ends of adjacent corner columns.

11. The housing unit of claim 10, further comprising a plurality of ground bases underneath each bearing point, wherein said housing shell has a predetermined rigidity that upon subsidence of one of said bases, the apportioned load of said base is apportioned to the remaining bases without significant sagging of said housing shell.

12. The housing unit of claim 1, further comprising:

a corner column received within the foundation structure at each juncture of a longitudinal and transverse beams; and an adjustable foundation post slidably received within each of said corner columns.

13. The housing unit of claim 12, further comprising:

a foundation pad mounted to each foundation post at the lower portion thereof by diagonal braces, said foundation pads defining an enlarged horizontal lower surface area, and a clamp at each foundation post.

14. The housing unit of claim 13 wherein said lower surface area defines a level horizontal plane on an uneven base.

15. The housing unit of claim 1, further comprising a base underneath each bearing point, wherein said comprise a bed of fragmented wood material above the ground.

16. The housing unit of claim 15, wherein the bases further comprise a cap of gravel or silt.

* * * * *

UNITED STATES PATENT AND TRADEMARK OFFICE

CERTIFICATE OF CORRECTION

PATENT NO. : 6,718,711 B1
DATED : April 13, 2004
INVENTOR(S) : R.L. Gilman

It is certified that error appears in the above-identified patent and that said Letters Patent is hereby corrected as shown below:

Title page,
Item [74], *Attorney, Agent, or Firm*, "Lindness" should read -- Kindness --

Column 5,
Line 43, "portions;" should read -- portions; and --
Line 63, "claim 1" should read -- claim 1, --

Column 6,
Line 25, "claims 1" should read -- claim 1, --
Line 48, "a longitudinal and transverse beams;" should read -- a longitudinal and transverse beam; --
Line 58, "claim 13" should read -- claim 13, --
Line 62, "wherein said comprise" should read -- wherein said bases comprise --

Signed and Sealed this

Twentieth Day of July, 2004

JON W. DUDAS
*Acting Director of the United States Patent and Trademark Office*